US005930576A

United States Patent [19]

Izumi

[11] Patent Number: 5,930,576

[45] Date of Patent: Jul. 27, 1999

[54] IMAGE FORMING APPARATUS

[75] Inventor: Tomoo Izumi, Osaka, Japan

[73] Assignee: Minolta Co., Ltd., Osaka, Japan

[21] Appl. No.: 09/140,096

[22] Filed: Aug. 26, 1998

[30] Foreign Application Priority Data

Sep. 29, 1997 [JP] Japan ..... 9-263015

[51] Int. Cl.[6] ..... G03G 21/00

[52] U.S. Cl. ..... 399/348; 15/256.51; 399/343; 399/350

[58] Field of Search ..... 399/343, 346, 399/348, 350; 15/256.51; 101/423, 425; 118/261, 262, 202, 203, 60; 430/125

[56] References Cited

U.S. PATENT DOCUMENTS

| | | | |
|---|---|---|---|
| 4,252,882 | 2/1981 | Herrmann | 430/117 |
| 4,272,599 | 6/1981 | Moradzadeh | 430/100 |
| 4,785,324 | 11/1988 | Yamazaki et al. | 399/128 |
| 5,559,593 | 9/1996 | Yoshinaga et al. | 399/343 |
| 5,710,966 | 1/1998 | Otsuka et al. | 399/343 |

*Primary Examiner*—Matthew S. Smith
*Attorney, Agent, or Firm*—Morrison & Foerster

[57] ABSTRACT

An image forming apparatus provides excellent images free from fogging or the like, even when highly viscous ink is used to form high-quality images, by using a simple cleaning unit capable of satisfactorily removing residual ink from a surface of an image bearing element after image transfer. The image forming apparatus of the invention further provides a viscosity reducing unit for reducing the viscosity of the ink remaining on the surface of the image bearing element after image transfer. The image forming apparatus includes a latent-image forming unit for forming an electrostatic latent image on the surface of the image bearing element; an ink developing unit for supplying ink to the surface of the image bearing element; a transfer unit for transferring the ink image formed on the image bearing element onto a recording medium; and a cleaning unit for removing the residual ink from the surface of the image bearing element after image transfer such that the viscosity reducing unit is disposed between the transfer unit and the cleaning unit.

17 Claims, 3 Drawing Sheets

IMAGE FORMING APPARATUS

This application is based on application No. 09-263015 filed in Japan, the content of which is hereby incorporated by reference.

BACKGROUND OF THE INVENTION

1. Field of the Invention

The present invention relates to an image forming apparatus wherein ink is supplied to an electrostatic latent image formed on a surface of an image bearing element to form an ink image, which is then transferred onto a recording medium to form an image thereon and the ink remaining on the surface of the image bearing element after image transfer is removed therefrom by means of a cleaning unit. The image forming apparatus according to the present invention is characterized by the cleaning unit capable of satisfactorily removing the residual ink from the surface of the image bearing element after image transfer.

2. Description of the Related Art

There has been used a conventional image forming apparatus represented by an electrophotographic copier which forms an electrostatic latent image on a surface of an image bearing element, develops the electrostatic latent image, and transfers it onto a recording medium such as paper to form an image thereon.

As an example of the electrophotographic image forming apparatus, there has been known one using a liquid developing agent composed of coloring resin particles (toner particles) dispersed in a liquid carrier to develop an electrostatic latent image.

A typical liquid developing agent used in the electrophotographic apparatus is composed of charged toner particles dispersed in an insulating liquid carrier. Since the toner particles in the liquid developing agent are selectively used as image formation proceeds, it is required to control the concentration of the toner particles in the liquid carrier, which causes the problems of troublesome control of the concentration of the toner particles and easy degradation of the liquid developing agent because, in most cases, the liquid carrier is used repeatedly over several times.

To form an image on a recording medium such as paper for photocopying, the electrophotographic apparatus thus using the liquid developing agent requires an additional device such as a fixing unit for fixing a toner image transferred onto the recording medium, resulting in a complicated and cumbersome apparatus.

There has also been proposed a conventional image forming apparatus as disclosed in U.S. Pat. No. 4,272,599 wherein ink is supplied to an electrostatic latent image formed on a surface of an image bearing element to form an ink image, which is then transferred onto a recording medium to form an image thereon and the ink remaining on the surface of the image bearing element after image transfer is removed therefrom by means of a cleaning unit.

In the case of supplying ink to the electrostatic latent image formed on the surface of the image bearing element and transferring the ink image onto the recording medium to form the image thereon, as described above, ink to be used preferably has a high viscosity to prevent the recording medium from being blurred with the ink and provide a high-quality image.

If such ink with a high viscosity is used, however, the cleaning unit cannot satisfactorily remove the residual ink from the surface of the image bearing element after image transfer, which causes the problems of fogging observed in the formed image and a need for a complicated and high-cost cleaning unit capable of satisfactorily removing the ink from the surface of the image bearing element.

SUMMARY OF THE INVENTION

It is therefore an object of the present invention to solve the aforesaid problems encountered in the image forming apparatus wherein ink is supplied to an electrostatic latent image formed on the surface of the image bearing element to form an ink image, which is then transferred onto a recording medium to form an image thereon and the ink remaining on the surface of the image bearing element is removed therefrom by means of a cleaning unit.

Specifically, the present invention aims at providing, even in the case where the foregoing image forming apparatus uses highly viscous ink to form a high-quality image, an excellent image free from fogging or the like by using a simple cleaning unit capable of satisfactorily removing the residual ink from the surface of the image bearing element after image transfer.

To attain the above object, an image forming apparatus according to the present invention comprises: a latent-image forming unit for forming an electrostatic latent image on a surface of an image bearing element; an ink developing unit for supplying ink to the surface of the image bearing element to form an ink image corresponding to the electrostatic latent image on the surface of the image bearing element; a transfer unit for transferring the ink image formed on the surface of the image bearing element onto a recording medium; and a cleaning unit for removing the ink remaining on the surface of the image bearing element after image transfer, wherein a viscosity reducing unit for reducing the viscosity of the ink remaining on the surface of the image bearing element after image transfer is further provided between the transfer unit and the cleaning unit.

Even in the case of using highly viscous ink to form a high-quality image, the viscosity of the ink remaining on the surface of the image bearing element after image transfer can be reduced by means of the viscosity reducing unit provided between the transfer unit and the cleaning unit in the image forming apparatus so as to reduce the viscosity of the ink remaining on the surface of the image bearing element. The arrangement ensures the removal of the residual ink from the surface of the image bearing element by means of a simple cleaning unit, so that fogging or the like is no more observed in the formed image.

In the case of using ink decreasing in viscosity with an increase in temperature as the aforesaid ink, a heating unit for heating ink is used appropriately as the viscosity reducing unit disposed between the transfer unit and the cleaning unit to reduce the viscosity of the ink remaining on the surface of the image bearing element after image transfer.

BRIEF DESCRIPTION OF THE DRAWINGS

These and other objects and features of the present invention will become apparent from the following description of preferred embodiments thereof taken in conjunction with the accompanying drawings, in which.

In the following description, like parts are designated by like reference numerals throughout the several drawings.

DETAILED DESCRIPTION OF THE PREFERRED EMBODIMENTS

Referring now to the accompanying drawings, an image forming apparatus according to the embodiments of the present invention will be described more specifically.

Embodiment 1

Figure 1:
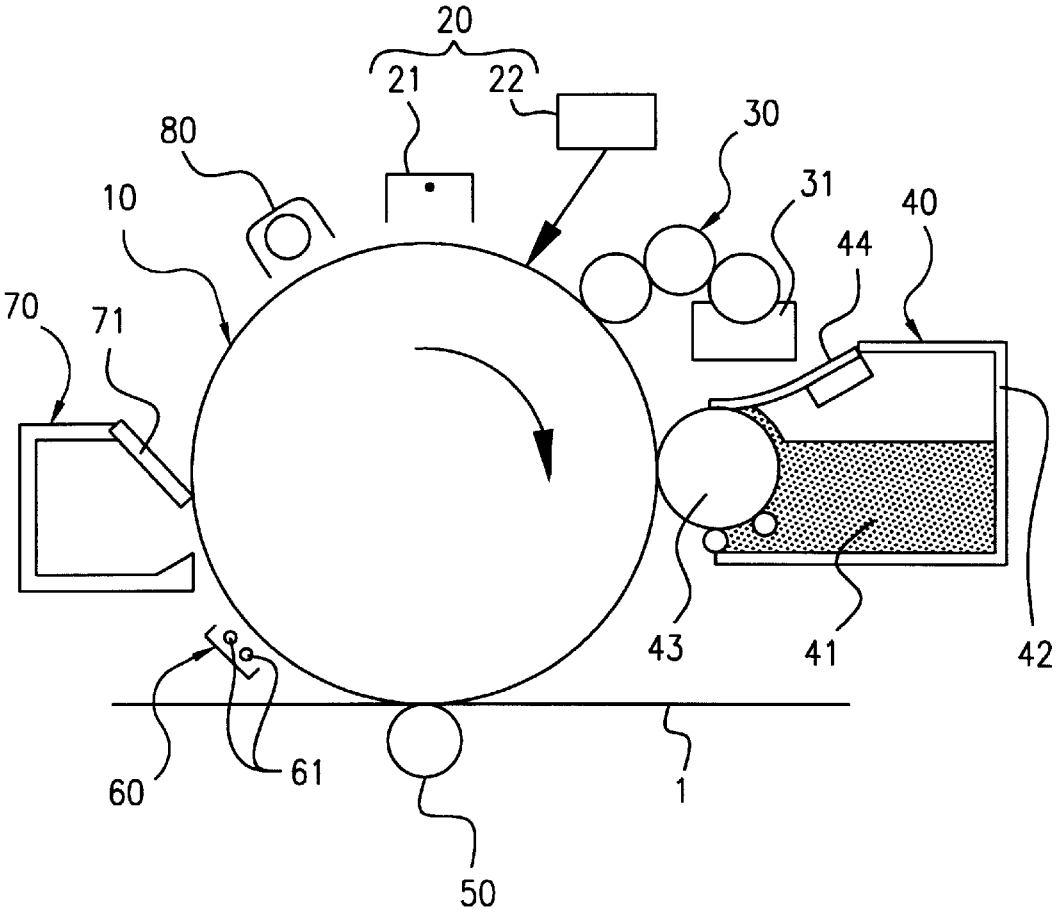
FIG. 1 is a schematic view illustrating an image forming apparatus according to Embodiment 1 of the present invention.

As shown in FIG. 1, an image forming apparatus according to the present embodiment uses as an image bearing element 10 a photosensitive element for electrophotography composed of a photosensitive layer formed on a surface of a cylindrical conductive member. In forming an electrostatic latent image on the image bearing element 10 by means of a latent-image forming unit 20, the surface of the image bearing element 10 is charged by a charging unit 21. Then, an exposing unit 22 performs exposure with respect to the charged surface of the image bearing element 10 based on image data to form an electrostatic latent image on the surface of the image bearing element 10.

After the electrostatic latent image is formed on the surface of the image bearing element 10, a mold-release-agent applying unit 30 applies a non-conductive mold release agent 31 such as silicone oil to the surface of the image bearing element 10 to a specifiedthickness. Thereafter, ink 41 is supplied from an ink developing unit 40 to the portion of the electrostatic latent image formed on the image bearing element 10 to form an ink image corresponding to the electrostatic latent image on the surface of the image bearing element 10.

In supplying the ink 41 from the ink developing unit 40 to the electrostatic latent image formed on the surface of the image bearing element 10, the ink 41 contained in the main body 42 of the ink developing unit 40 is held on the surface of an ink bearing element 43 in the form of a drum. The amount of the ink 41 held on the surface of the ink bearing element 43 is controlled by a control member 44 such that the layer of the ink 41 held on the surface of the ink bearing element 43 has a specified thickness. The ink 41 held on the surface of the ink bearing element 43 is brought into contact with the surface of the image bearing element 10 such that the ink 41 is supplied to the portion of the electrostatic latent image formed on the surface of the image bearing element 10. In the case where the ink 41 held on the surface of the ink bearing element 43 is thus brought into contact with the image bearing element 10 and thereby supplied to the portion of the electrostatic latent image formed on the surface of the image bearing element 10, the ink bearing element 43 is preferably pressed gently against the image bearing element 10. This is because, if the ink bearing element 43 is tightly pressed against the image bearing element 10, the ink 41 may also be supplied to the portion unformed with the electrostatic latent image and therefore fogging is more likely to occur in the formed image.

After the ink 41 is supplied from the ink developing unit 40 to the electrostatic latent image formed on the image bearing element 10 to form the ink image on the surface of the image bearing element 10, the ink image formed on the surface of the image bearing element 10 is transferred onto a recording medium 1 by means of a transfer roller 50 as a transfer unit.

After the ink image is thus transferred onto the recording medium, the viscosity of the residual ink 41 not transferred onto the recording medium 1 but remaining on the surface of the image bearing element 10 is reduced by means of a viscosity reducing unit 60.

To reduce the viscosity of the ink 41 remaining on the surface of the image bearing element 10 by means of the viscosity reducing unit 60, the present embodiment has disposed the heating unit 60 using a halogen lamp 61 in close proximity to the surface of the image bearing element 10 so as to heat the ink 41 remaining on the surface of the image bearing element 10 by means of the heating unit 60 and thereby reduce the viscosity of the ink 41.

After the viscosity of the ink 41 remaining on the surface of the image bearing element 10 is thus reduced by means of the heating unit 60, the residual ink 41 is removed from the surface of the image bearing element 10 by means of the cleaning unit 70 disposed downstream of the heating unit 60 in the direction of movement of the image bearing element 10. In the present embodiment, the edge portion of a cleaning blade 71 provided in the cleaning unit 70 is pressed against the surface of the image bearing element 10 to remove the ink 41 with a reduced viscosity from the surface of the image bearing element 10.

Figure 2:
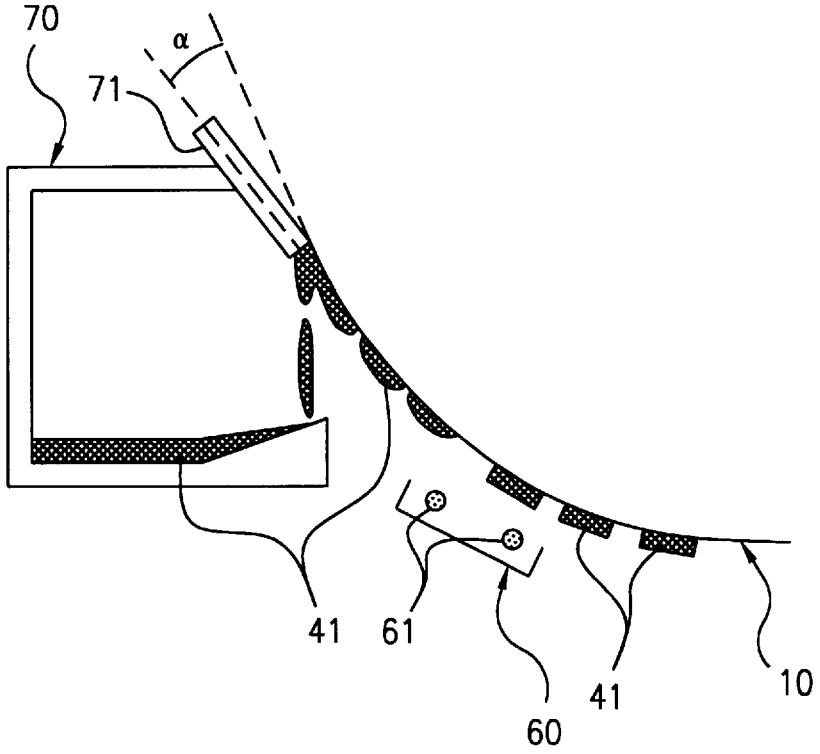
FIG. 2 is a partially enlarged view illustrating the process of heating ink remaining on a surface of an image bearing element after image transfer by means of a heating unit and removing the residual ink from the surface of the image bearing element by means of a cleaning unit in the image forming apparatus according to Embodiment 1.

The cleaning blade 71 provided in the cleaning unit 70 is typically composed, of an elastic material, such as urethane rubber, having a hardness on the order of 60 to 75 degrees. In pressing the edge portion of the cleaning blade 71 against the surface of the image bearing element 10, an angle as shown in FIG. 2 formed between the cleaning blade 71 and a tangential line to the portion thereof in contact with the image bearing element 10 is adjusted properly to range from 15° to 30°.

After the residual ink 41 is thus removed from the surface of the image bearing element 10, charges remaining on the surface of the image bearing element 10 are removed by means of a charge removing unit 80.

Figure 3:
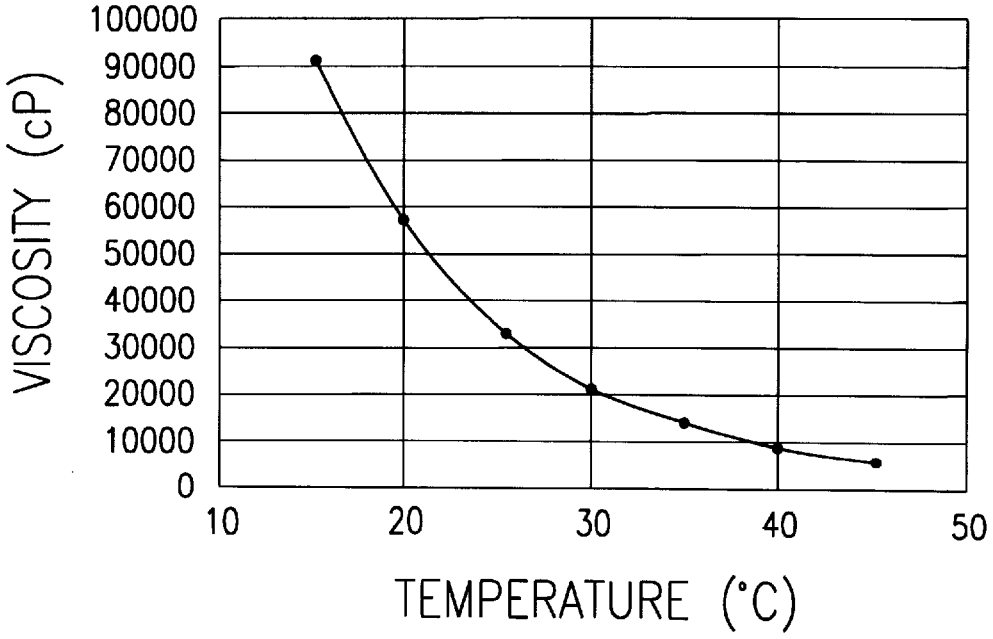
FIG. 3 shows the relationship between the viscosity and temperature of the ink used in an experiment using the image forming apparatus according to Embodiment 1.

In the image forming apparatus according to Embodiment 1, Best Cure Ink commercially available from T&K Co. having a viscosity varying with increases in temperature as shown in FIG. 3 was used as the ink 41. The viscosity of the ink 41 shown in FIG. 3 was measured at a shear speed of 50 sec-1. Typically, the ink may comprise a thermoplastic resin, such as polyester resin, styrene resin, acrylic resin and e.t.c.

The image bearing element 10 was moved at a speed of 100 mm/sec. Urethane rubber with a hardness of 68 degrees was used to compose the cleaning blade 71 of the cleaning unit 70. The angle $\alpha$ formed between the cleaning blade 71 and the tangential line to the portion thereof in contact with the image bearing element 10 was adjusted to 25°.

The layer thickness of the ink 41 remaining on the surface of the image bearing element 10 after image transfer was adjusted to 5 $\mu$m and power of 100 W is supplied to the halogen lamp 71 of the heating unit 60 so as to heat the ink 41 remaining on the surface of the image bearing element 10. The distance between the heating unit 60 and the surface of the image bearing element 10 was varied to vary the temperature of the ink 41 remaining on the surface of the image bearing element 10.

The temperature of the ink 41 prior to heating by means of the heating unit 60 was adjusted to 20°. The temperature of the ink 41 after heating by means of the heating unit 60 was varied in the range of 20 to 45° C. as shown in the following Table 1. The cleaning performance of the cleaning unit 70 was then evaluated, the result of which was also shown in Table 1.

TABLE 1

| Temperature of ink after heating | Cleaning performance |
|---|---|
| 20° C. | Inferior |
| 25° C. | Slightly inferior |
| 30° C. | Superior |
| 35° C. | Superior |
| 40° C. | Superior |
| 45° C. | Superior |

As will be understood from Table 1, the heating of the ink 41 remaining on the surface of the image bearing element 10 improved the cleaning performance of the cleaning unit 70. In particular, the residual ink 41 was surely removed from the surface of the image bearing element 10 when the ink 41 remaining on the surface of the image bearing element 10 was heated to a temperature of 30° C. or higher such that the viscosity of the ink 41 measured at the foregoing shear speed of 50 sec-1 became 25000 cP or less.

Embodiment 2

An image forming apparatus according to Embodiment 2 uses an image bearing element 10 in the form of an endless belt, which is composed a dielectric layer provided on a conductive member. The image bearing element 10 in the form of an endless belt is entrained around three rollers 11 such that the image bearing element 10 moves with the rotation of the rollers 11.

As a material composing the dielectric layer provided on the conductive member, there can be used rubber such as silicone rubber or an insulating transparent resin such as a polyethylene resin, a polyethylene terephthalate resin, a polyimide resin, a polyamideimide resin, a poly(etherimide) resin, a poly(ether sulphone) resin, a poly(ether ether ketone) resin, a silicone resin, or a fluorocarbon resin, each of which is excellent in mold releasing property and in durability.

As the image forming unit 20 for forming an electrostatic latent image on the surface of the image bearing element 10, an electrostatic head is used. The electrostatic latent image is formed on the surface of the image bearing element 10 by controlling the ON-OFF states of a current of ions in the electrostatic head.

After the electrostatic latent image is formed on the surface of the image bearing element 10, the present embodiment does not apply the mold releasing agent 31 to the surface of the image bearing element 10 but the ink 41 is supplied from the ink developing unit 40 to the portion of the electrostatic latent image formed on the image bearing element 10, similarly to Embodiment 1, whereby an ink image corresponding to the electrostatic latent image is formed on the surface of the image bearing element 10.

Subsequently, the ink image formed on the surface of the image bearing element 10 is guided to a position opposed to the transfer roller 50, while the recording medium 1 is guided into the space between the transfer roller 50 and the image bearing element 10, so that the ink image formed on the image bearing element 10 is transferred onto the recording medium 1 by the transfer roller 50.

After the ink image is transferred to the recording medium 1, the viscosity of the ink 41 not transferred to the recording medium 1 but remaining on the surface of the image bearing element 10 is reduced by the viscosity reducing unit 60.

Figure 4:
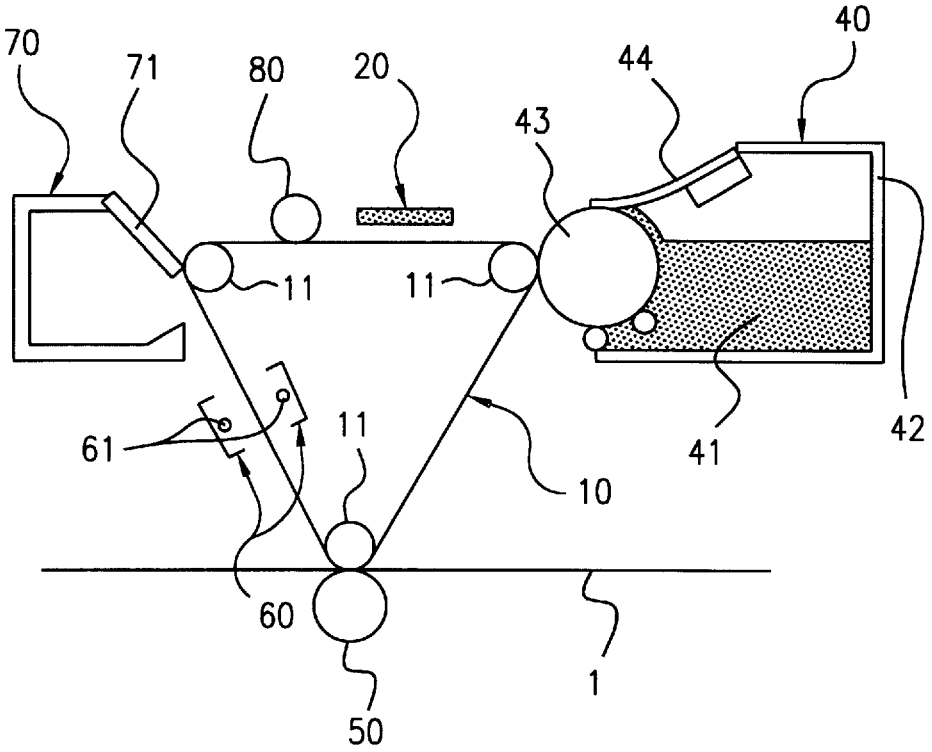
FIG. 4 is a schematic view illustrating an image forming apparatus according to Embodiment 2 of the present invention.

As shown in FIG. 4, the present embodiment has disposed the heating unit 60 using the halogen lamp 61 downstream of the transfer roller 50 in the direction of movement of the image bearing element 10 such that the heating unit 60 is in close proximity to both faces of the image bearing element 10. The ink 41 remaining on the surface of the image bearing element 10 after image transfer is heated by the heating unit 60 so that the viscosity thereof is reduced.

After the viscosity of the ink 41 remaining on the surface of the image bearing element 10 is thus reduced by the heating unit 60, the residual ink 41 is removed from the surface of the image bearing element 10 by the cleaning unit 70 provided downstream of the heating unit 60 in the direction of movement of the image bearing element 10. In the present embodiment also, the edge portion of the cleaning blade 71 provided in the cleaning unit 70 is pressed against the surface of the image bearing element 10, similarly to the case of Embodiment 1, thereby removing the ink 41 with a reduced viscosity from the surface of the image bearing element 10.

Since the viscosity of the ink 41 remaining on the surface of the image bearing element 10 after image transfer has also been reduced with the application of heat by the heating unit 60 in the image forming apparatus according to the present embodiment, the residual ink 41 is surely removed from the surface of the image bearing element 10 by means of the cleaning unit 70, which suppresses the occurrence of fogging in the formed image.

As described above in detail, the image forming apparatus according to the present invention is provided with the viscosity reducing unit disposed between the transfer unit for transferring the ink image formed on the surface of the image bearing element onto the recording medium and the cleaning unit for removing the ink remaining on the surface of the image bearing element after image transfer so that the viscosity of the ink remaining on the image bearing element after image transfer is reduced by the viscosity reducing unit. Consequently, even when highly viscous ink is used to form a high-quality image, the ink remaining on the surface of the image bearing element after image transfer can surely be removed therefrom by means of a simple cleaning unit.

Therefore, the use of the image forming apparatus according to the present invention allows a high-quality image free from fogging to be formed constantly.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

an image bearing element that an ink image is formed thereon;

a transfer unit for transferring the ink image onto a recording medium;

a cleaning unit for removing a residual ink from the surface of the image bearing element; and a viscosity reducing device provided between said transfer unit and said cleaning unit to reduce the viscosity of the residual ink.

2. An image forming apparatus according to claim 1, wherein the ink comprises a thermoplastic resin and the viscosity reducing device comprises a heater for melting the thermoplastic resin.

3. An image forming apparatus according to claim 2, wherein the heater includes a halogen lamp being separated from the surface of the image bearing element.

4. An image forming apparatus according to claim 2, wherein the cleaning unit comprises a cleaning blade which is made of an elastic material.

5. An image forming apparatus according to claim 4, wherein the cleaning blade has a hardness on the Shore A hardness scale in a range from 60 to 75 degrees.

6. An image forming apparatus according to claim 5, wherein an angle $\alpha$ formed between the cleaning blade and a tangential line to the portion thereof in contact with the image bearing element is adjusted properly to range from 15° to 30°.

7. An image forming apparatus according to claim 2, wherein the image bearing element includes a plurality of rollers and an endless belt which is entrained around the rollers.

8. An image forming apparatus according to claim 2, wherein the image bearing element is made of a material which is selected from the group consisting of a polyethylene resin, a polyethylene terephthalate resin, a polyimide resin, a polyamideimide resin, a poly(etherimide) resin, a poly(ether sulphone) resin, a poly(ether ether ketone) resin, a silicone resin, and a fluorocarbon resin.

9. An image forming apparatus according to claim 1, further comprises a mold-release-agent applying unit applying a non-conductive mold release agent onto the surface of the image bearing element, wherein the ink image is formed onto the surface of the image bearing element which is applied the non-conductive mold release agent.

10. An image forming apparatus according to claim 9, wherein the mold-release-agent is silicone oil.

11. An image forming apparatus comprising:

an image bearing element;

an ink developing unit for supplying ink to a surface of the image bearing element to form an ink image corresponding to an electrostatic latent image on the surface of the image bearing element;

a transfer unit for transferring said ink image onto a recording medium;

a cleaning unit for removing the residual ink from the surface of said image bearing element; and a viscosity reducing unit provided between said transfer unit and said cleaning unit to reduce the viscosity of the ink remaining on said image bearing element.

12. An image forming apparatus according to claim 11, wherein the ink has a viscosity decreasing with an increase in the temperature thereof, and the viscosity reducing unit comprises a heating unit for heating the ink.

13. An image forming apparatus according to claim 11, wherein the ink comprises a thermoplastic resin and the viscosity reducing unit comprises a heater for melting the thermoplastic resin.

14. An image forming apparatus according to claim 13, wherein the heater includes a halogen lamp being separated from the surface of the image bearing element.

15. An image forming apparatus according to claim 11, further comprises a mold-release-agent applying unit applying a non-conductive mold release agent onto the surface of the image bearing element, wherein the ink image is formed onto the surface of the image bearing element which is applied the non-conductive mold release agent.

16. An image forming apparatus according to claim 15, wherein the mold-release-agent is silicone oil.

17. An image forming method comprising the steps of:

forming an ink image onto an image bearing element;

transferring the ink image onto a recording medium;

reducing the viscosity of a residual ink which is remained on the surface of the image bearing element; and cleaning the residual ink from the surface of the image bearing element.

* * * * *